United States Patent [19]

Osika et al.

[11] Patent Number: 4,870,230

[45] Date of Patent: Sep. 26, 1989

[54] SAFETY ROCKER

[75] Inventors: Thomas F. Osika, Valparaiso; John Stuhlmacher, Crown Point, both of Ind.

[73] Assignee: McGill Manufacturing, Valparaiso, Ind.

[21] Appl. No.: 114,129

[22] Filed: Oct. 28, 1987

[51] Int. Cl.[4] ..... H01H 27/00

[52] U.S. Cl. ..... 200/6 R; 200/43.04; 200/339

[58] Field of Search ..... 200/6 R, 6 A, 6 B, 6 BA, 200/6 BB, 6 C, 43.04, 321, 322, 323, 339

[56] References Cited

U.S. PATENT DOCUMENTS 4,291,207 9/1981 Reinke et al. ..... 200/339 X

*Primary Examiner*—A. D. Pellinen

*Assistant Examiner*—Morris Ginsburg

[57] ABSTRACT

An electrical switch includes a rocker-type actuator adapted to be pivoted between first and second positions within a housing in order to close and open switch contacts. The actuator carries a latch which normally engages the housing to prevent the actuator from being pivoted to its switch-closed position. By pulling on the latch and then lifting on the actuator, the actuator may be pivoted to its switch-closed position; the two-step operation protecting against accidental actuation of the switch. The actuator may be returned to its switch-open position by a simple single motion thereby enabling rapid opening of the switch under emergency conditions. In one embodiment, the latch cannot be moved to an unlatched position and the switch cannot be actuated unless an authorized person with a key connects the key detachably to the latch.

14 Claims, 6 Drawing Sheets

FIG. 15
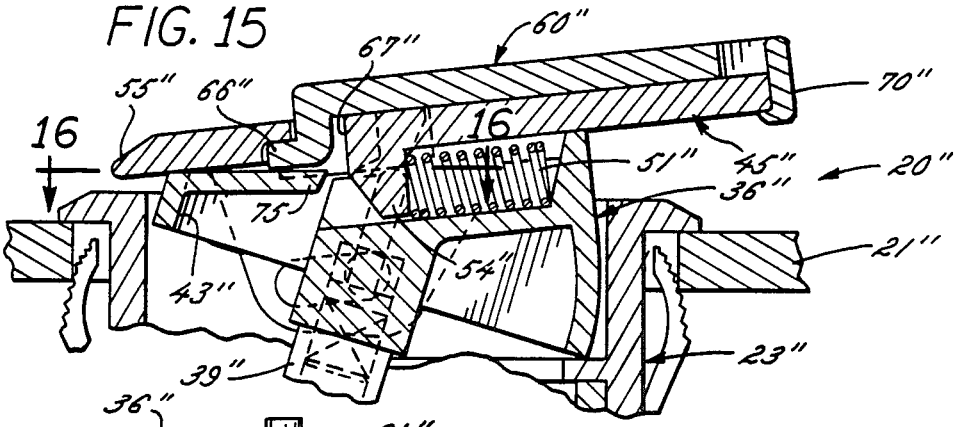
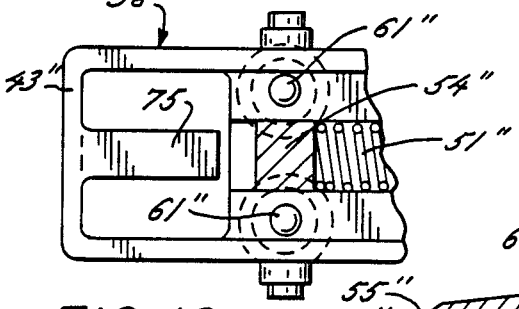
FIG. 16
FIG. 17
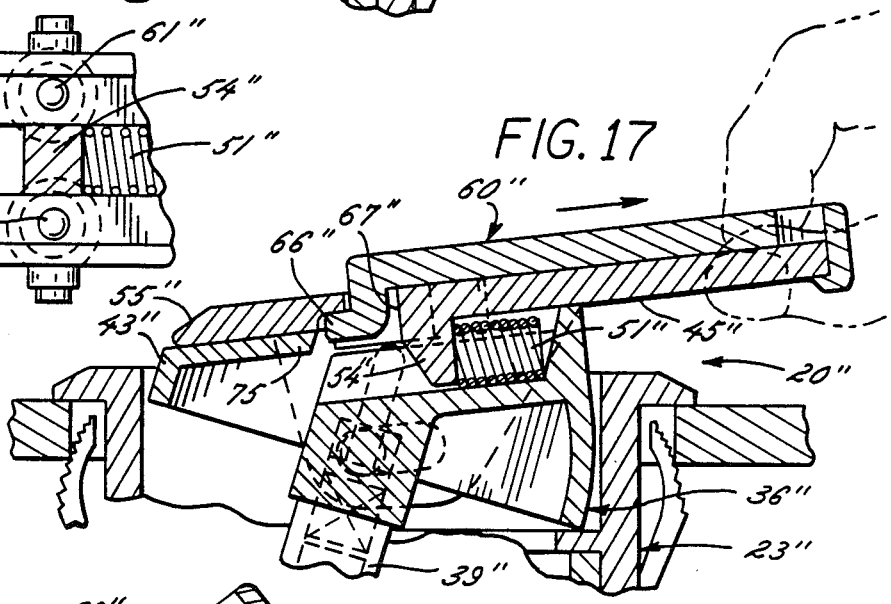
FIG. 18
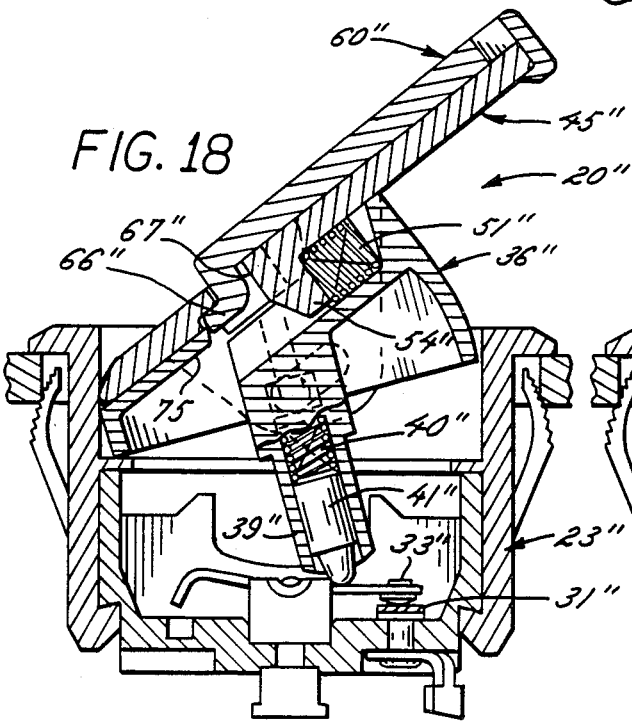
FIG. 19
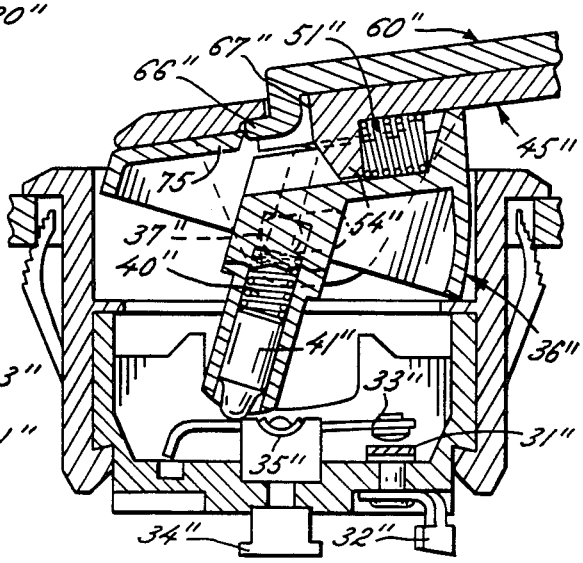

SAFETY ROCKER

BACKGROUND OF THE INVENTION

This invention relates generally to a switch and, more particularly, to a switch of the type having a pivotally mounted rocker actuator. When the rocker is pivoted between first and second positions, it changes the state of the switch contacts.

With certain types of equipment such as power tools, power take-off attachments for tractors, and other equipment which might possibly cause injury, it is desirable to protect the switch against accidental actuation or against actuation by unauthorized persons. While certain safety switches have been designed to guard against accidental actuation, such switches are relatively complex and expensive and, in some instances, can still be actuated accidentally in spite of the measures which are taken to ostensibly prevent such actuation.

SUMMARY OF THE INVENTION

The general aim of the present invention is to provide a new and improved rocker switch which is of comparatively simple and low cost construction and which effectively guards against accidental actuation and/or actuation by unauthorized persons.

A more detailed object of the invention is to achieve the foregoing by providing a rocker switch which can be actuated only if two separate and distinct motions are applied to the switch.

Still another object is to provide a rocker switch of the foregoing type which is adapted to be quickly deactuated with a simple single motion so as to simplify opening of the switch and to permit rapid opening of the switch under emergency conditions.

A further object of the invention is to provide a safety switch which can be actuated only by an authorized person having a separate releasing member adapted to be temporarily connected to the switch.

Still a further object is to provide a switch in which the releasing member can be used to disable the normal two-stage actuating function of the switch and to enable an authorized person to repeatedly actuate the switch with a simple single motion.

These and other objects and advantages of the invention will become more apparent from the following detailed description when taken in conjunction with the accompanying drawings.

BRIEF DESCRIPTION OF THE DRAWINGS

FIG. 15 is a fragmentary cross-section taken similar to FIG. 2 but shows yet another embodiment of a switch constructed in accordance with the invention.

FIG. 16 is a fragmentary cross-section taken substantially along the line 16—16 of FIG. 15.

FIGS. 17, 18 and 19 are views similar to FIG. 15 but show successively moved positions of certain components of the third embodiment of the switch.

DETAILED DESCRIPTION OF THE PREFERRED EMBODIMENTS

Figure 1:
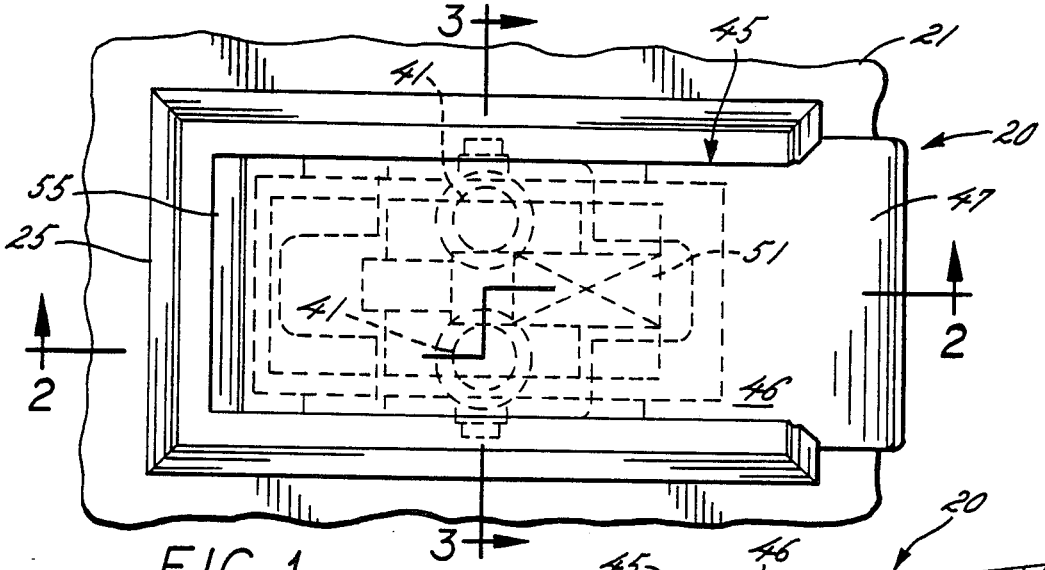
FIG. 1 is a top plan view of one embodiment of a new and improved safety switch incorporating the unique features of the present invention.

For purposes of illustration, the present invention has been shown in the drawings as being incorporated in an electrical switch 20 for making or breaking a circuit to an electrical utilization device (not shown). By way of example, the utilization device may be a solenoid which, when energized, causes the power take-off of a tractor to engage.

In the present instance, the switch 20 has been shown in conjunction with a mounting plate 21 which is formed with a rectangular hole 22 for receiving the switch. The switch includes a main body or housing 23 (FIG. 2) which is partially defined by a molded plastic sleeve 24 of rectangular cross-section telescoped into the opening 22 and formed with a peripheral flange 25 which engages the upper side of the plate around the margins of the opening. Cantilevered fingers 26 are molded integrally with and are hinged to the sleeve and are adapted to pass through the opening 22 during insertion of the sleeve into the opening. Just after such insertion, the fingers 26 spring outwardly and engage the lower portion of the edge of the opening 22 so as to hold the sleeve 24 in the opening.

The housing 23 also includes an upwardly opening cup 27 (FIG. 2) made of plastic and adapted to be telescoped into the lower end portion of the sleeve 24, the upper edge of the cup engaging a radially inwardly projecting flange 28 formed integrally with the sleeve about midway along the height of the sleeve. An annular rib 29 on the lower end portion of the sleeve 24 snaps into an annular groove 30 in the lower end portion of the cup 27 in order to hold the sleeve and the cup in assembled relation.

Figure 2:
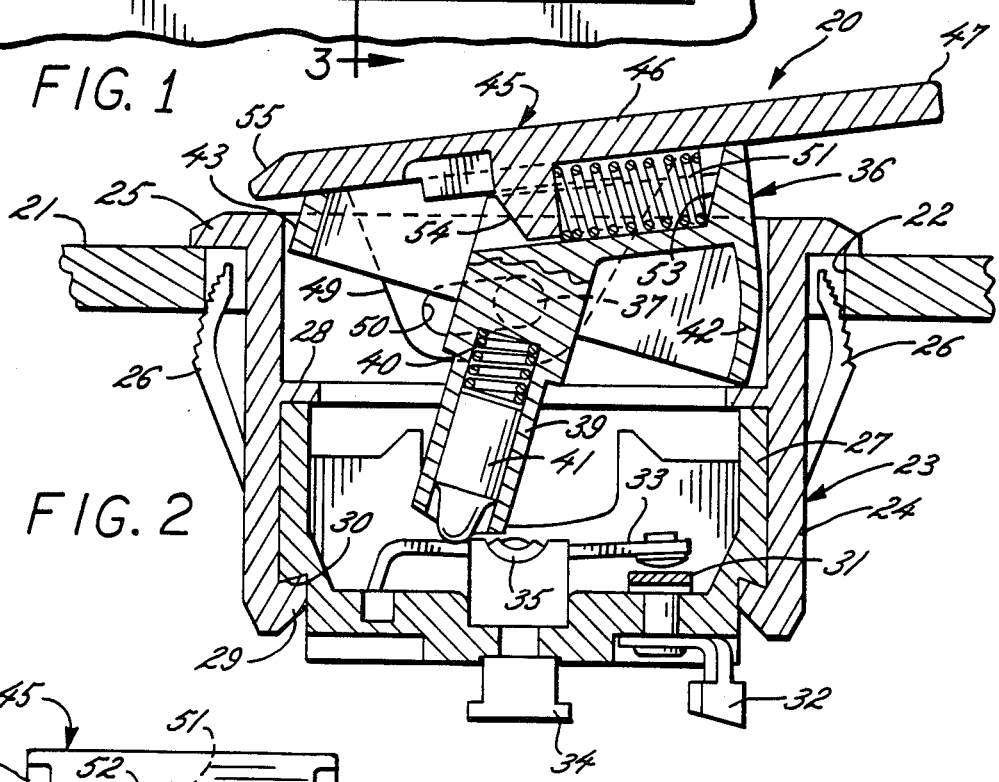
FIGS. 2 and 3 are fragmentary cross-sections taken substantially along the lines 2—2 and 3—3, respectively, of FIG. 1.

Located in the bottom of the cup 24, are two side-by-side switch contacts 31 connected to terminals 32, only one contact and one terminal being visible. Associated with each contact 31 is an elongated contact 33 connected to a terminal 34 and supported to rock about a fulcrum 35. When each contact 33 is positioned as shown in FIG. 2, it is spaced above the overlying contact 31 and thus the switch 20 is open. Clockwise pivoting of the contacts 33 about the fulcrum 35 brings the contacts 33 into engagement with the contacts 31 as shown in FIG. 5 in order to close the switch.

Figure 3:
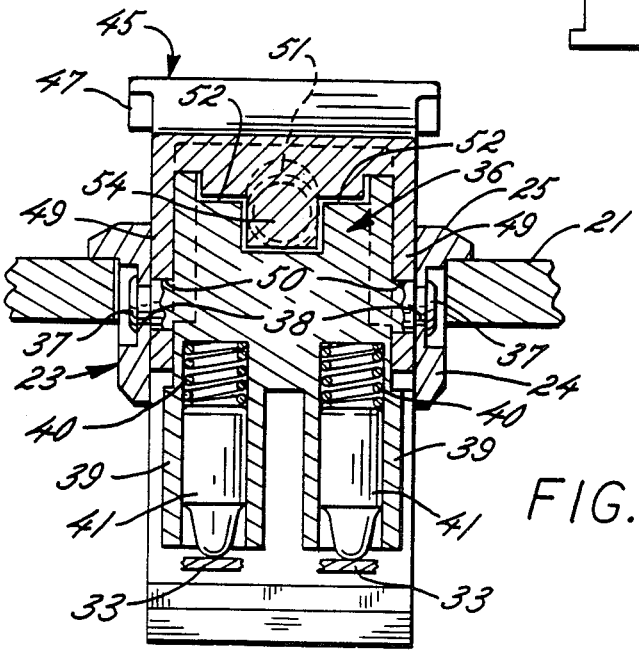
Figure 5:
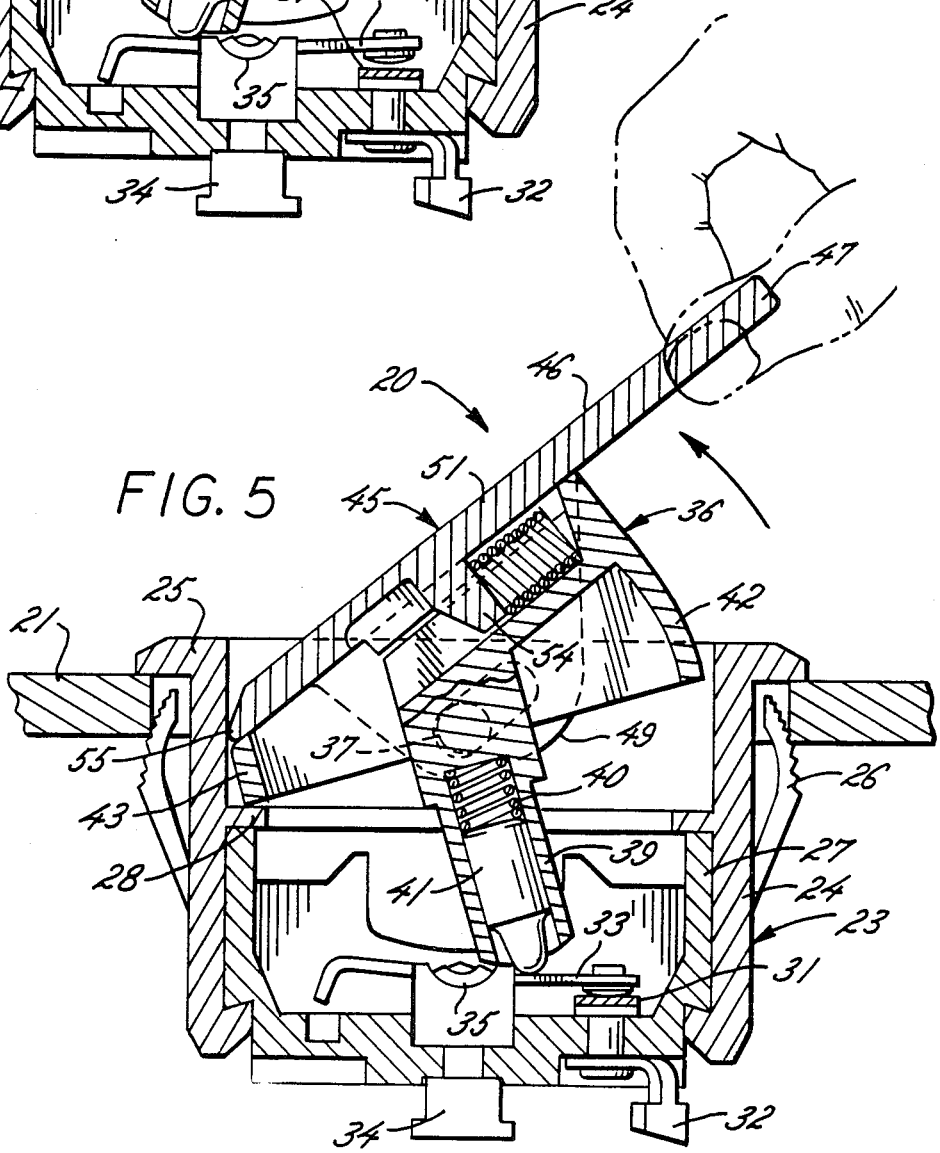
Figure 6:
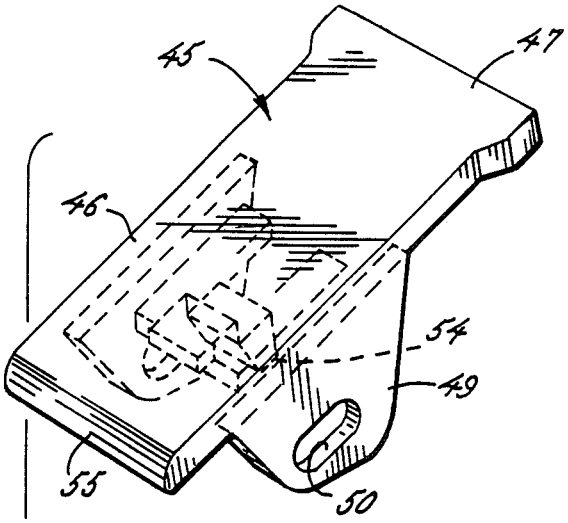
FIG. 6 is an exploded perspective view of certain components of the switch.
Figure 7:
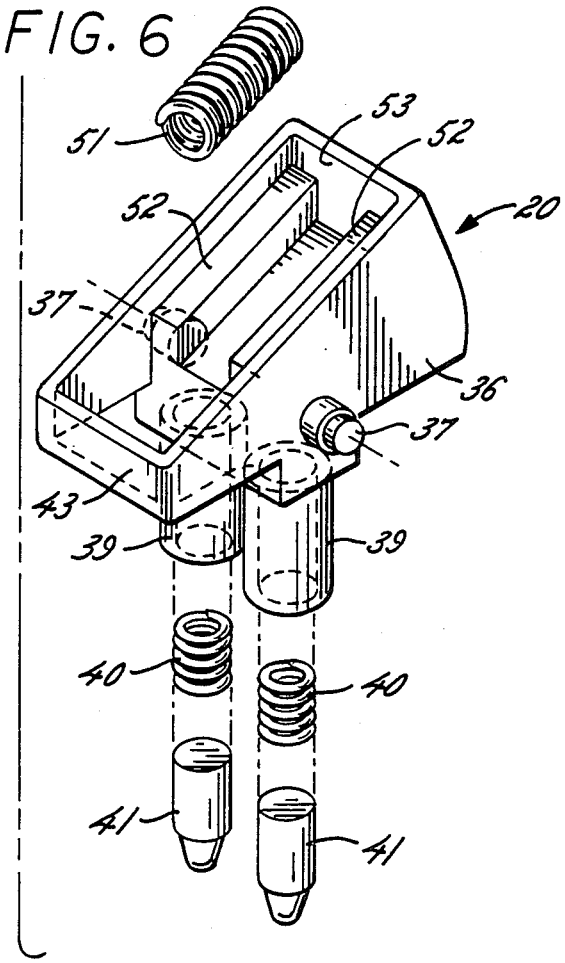
FIG. 7 is a perspective view similar to FIG. 6 but shows certain components of a second embodiment of a switch made in accordance with the invention.
Figure 7:
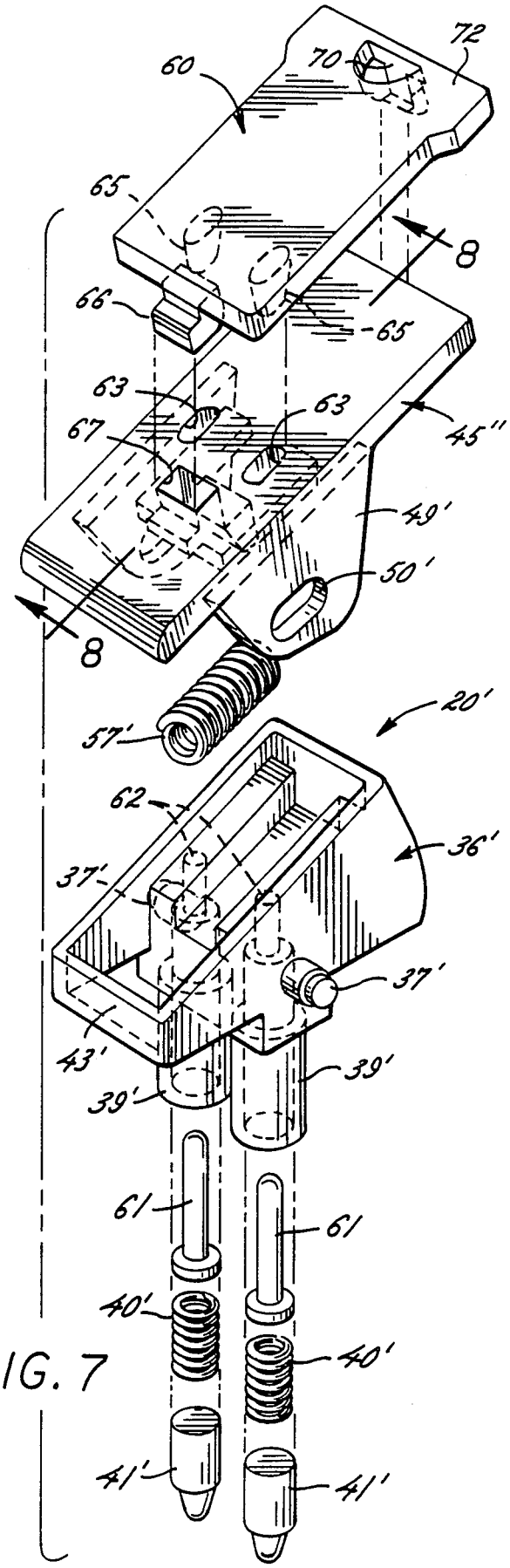
Figure 8:
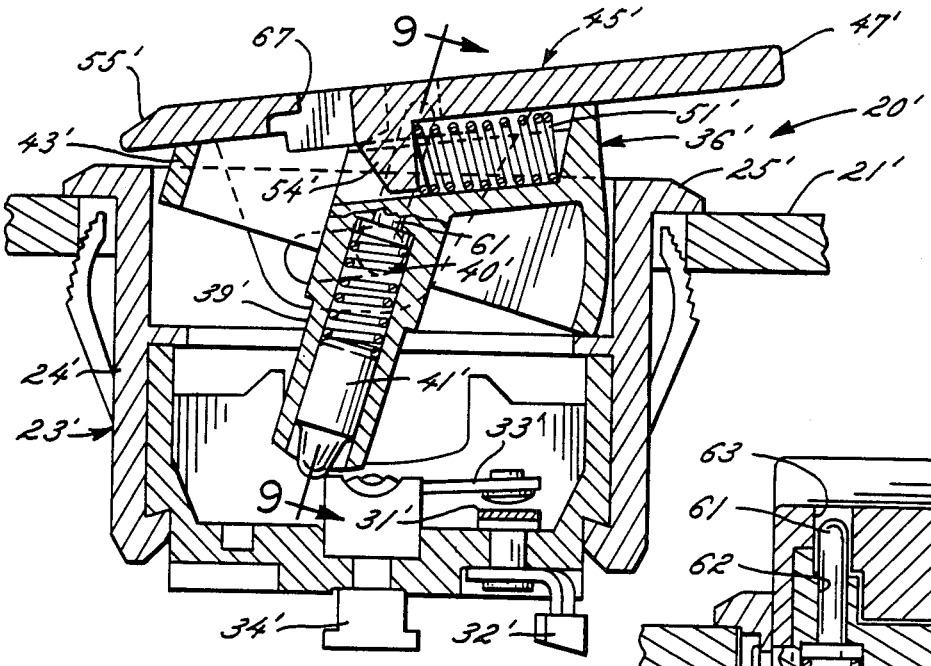
FIG. 8 is a cross-sectional view generally similar to FIG. 2 but shows the second embodiment of the switch taken along line 8—8 of FIG. 7.
Figure 9:
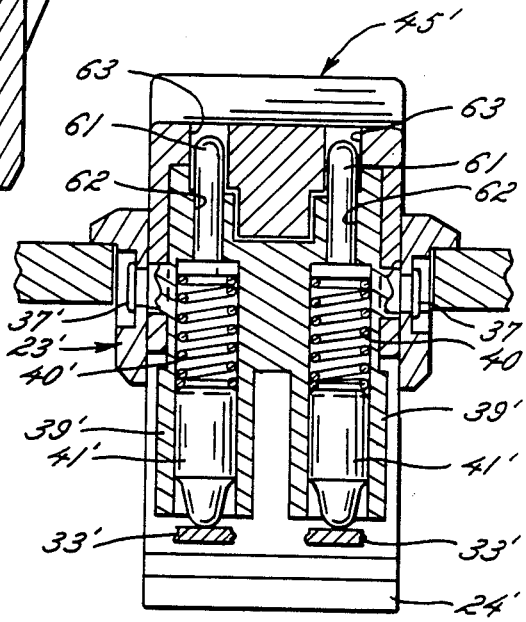
FIG. 9 is a fragmentary cross-section taken substantially along the line 9—9 of FIG. 8.
Figure 10:
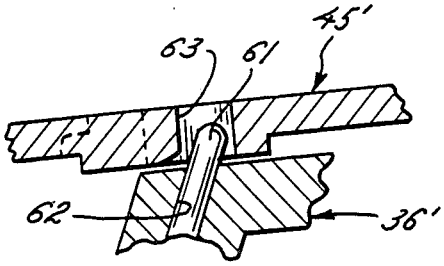
FIG. 10 is a fragmentary sectional view of certain parts shown in FIG. 8.

Pivoting of the contacts 33 is effected by a rocker-type actuator 36 which is supported by the sleeve 24 of the housing 23 to pivot between first and second positions (FIGS. 2 and 5). Herein, the rocker 36 is molded of plastic and is formed with two oppositely extending pins 37 (FIGS. 3 and 6) which project through circular holes 38 (FIG. 3) to support the rocker for pivoting about a horizontal axis. The rocker is formed with a pair of side-by-side and generally vertical sleeves 39 (FIGS. 3 and 6) which house springs 40 and plungers 41, the springs biasing the plungers downwardly against the switch contacts 33. When the rocker 36 is positioned as shown in FIG. 2, the springs press the plungers downwardly against the left end portions of the contacts 33 and bias the contacts in a counterclockwise direction about the fulcrum 35 so as to hold the contacts out of engagement with the contacts 31. In addition, the springs 40 tend to urge the rocker 36 clockwise about the axis of the pins 37 and tend to press a skirt portion 42 of the rocker against the upper side of the flange 28 (see FIG. 2).

When the rocker 36 is pivoted counterclockwise about the axis of the pins 37 from the position shown in FIG. 2 to the position shown in FIG. 5, the plungers 41 ride from left-to-right along the contacts 33, cross over the fulcrum 35 and then bear downwardly against the right end portions of the contacts 33 so as to press such contacts downwardly against the contacts 31 and thereby close the switch 20. At this time, the springs 40 tend to urge the rocker 36 in a counterclockwise direction and act to press a skirt portion 43 (FIG. 5) of the rocker against the flange 28.

In accordance with the present invention, the switch 20 is provided with a relatively simple and inexpensive latch 45 which prevents the switch rocker 36 from being actuated to its switch-closed position unless two separate and distinct motions are applied to the switch. The latch, however, enables the switch to be deactuated or opened with a simple single motion. Thus, the switch 20 is truly a safety switch in that separate motions are required for actuation so as to prevent accidental closing of the switch and yet, at the same time, the switch may be quickly opened under an emergency condition with a quick and simple single motion.

Figure 4:
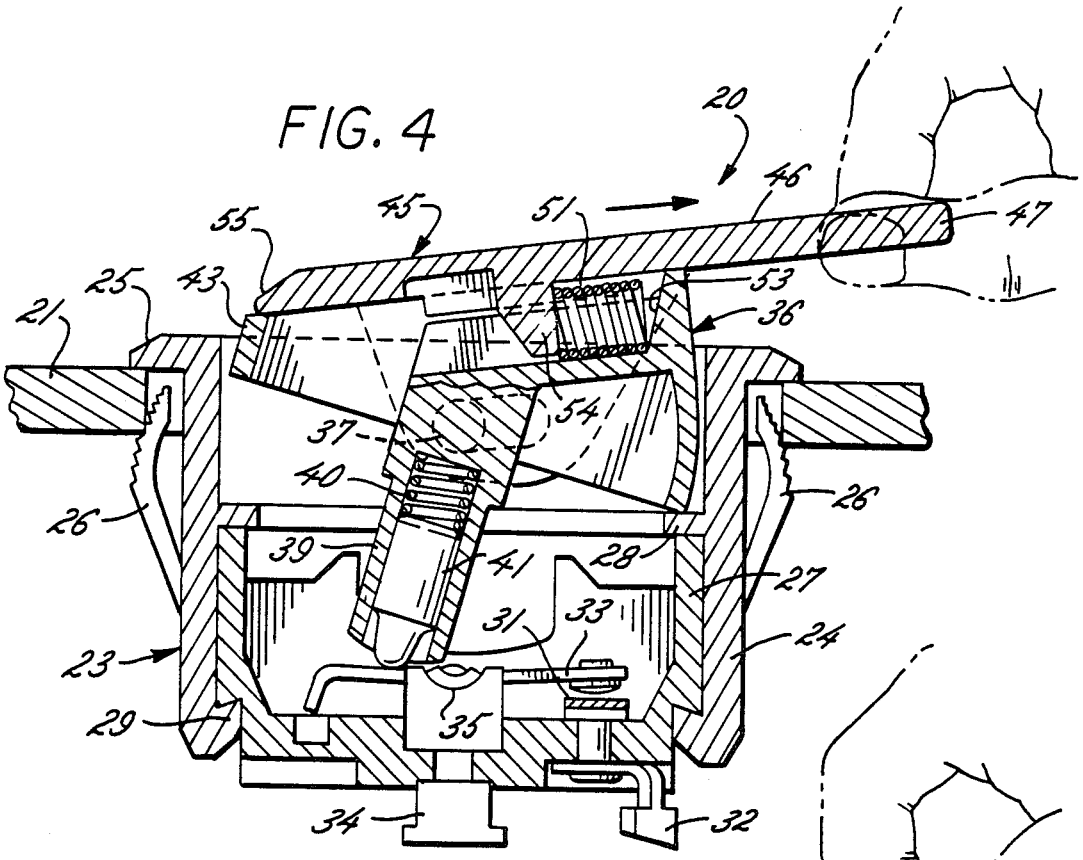
FIGS. 4 and 5 are views generally similar to FIG. 2 but show successively moved positions of certain components of the switch.

More specifically, the latch 45 includes a flat and elongated plate 46 molded of plastic and formed with a somewhat enlarged gripping portion or handle 47 at one end. Formed integrally with and depending from the plate are two laterally spaced ears 49 (FIGS. 3 and 6) which straddle the rocker 36. Each ear is formed with an elongated and generally horizontal slot 50 which receives the adjacent pin 37 with a sliding fit. The pins and slots thus mount the latch 45 for back and forth sliding on the rocker 36 between a latched position (FIG. 2) and an unlatched position (FIG. 4). A coil spring 51 urges the latch toward its latched position. For this purpose, the spring is retained between laterally spaced ribs 52 (FIG. 6) in the rocker 36 and is compressed between a wall 53 of the rocker and a lug 54 which extends downwardly from the lower side of the plate 46 of the latch 45.

When the rocker 36 is in its first or "open" position as shown in FIG. 2, the latch 45 is in its latched position and, in this position, a nose 55 on the end of the latch plate 46 overlies the flange 25 of the sleeve 24. If the rocker 36 is pivoted counterclockwise toward its second or "closed" position, the nose 55 engages the flange 25 and limits counterclockwise pivoting of the rocker to a very small angular distance which is insufficient to close the switch 20.

To close the switch 20, the handle 47 of the latch 45 is gripped between a thumb and a forefinger and the latch is slid from left-to-right relative to the rocker 36 and against the biasing force of the spring 51 until the latch reaches its unlatched position shown in FIG. 4. As a result of such sliding, the nose 55 of the latch clears the flange 25 and permits the rocker 36 to be pivoted counterclockwise to its switch-closed position by lifting upwardly on the handle 47 of the latch. Accordingly, it is necessary first to pull on the latch and then to lift the latch in order to pivot the rocker 36 counterclockwise to its switch-closed position shown in FIG. 5.

As the rocker 36 is pivoted to its switch-closed position (FIG. 5), the nose 55 of the latch 45 moves into the sleeve 24 and rides along the inner wall thereof. When the latch 45 is released from between the thumb and forefinger, the spring 51 presses the nose 55 of the latch into frictional engagement with the inner wall of the sleeve 24 to help hold the rocker 36 in a stable switch-closed position.

To open the switch 20, it is necessary only to push or slam the handle 47 of the latch 45 downwardly in order to pivot the rocker 36 in clockwise direction. As an incident thereto, the nose 55 of the latch rides upwardly out of the sleeve 24 and clears the sleeve so as to enable the spring 51 to return the latch to its latched position with the nose again overlying the flange 25 and again limiting counterclockwise pivoting of the rocker. Thus, the switch may be opened with a single motion and may be opened rapidly in an emergency situation.

From the foregoing, it will be apparent that the present invention brings to the art a new and improved safety switch 20 which requires two distinct motions for closing but only a single simple motion for opening. A basic rocker switch essentially may be made as a safety switch 20 simply by incorporating the latch 45 and the spring 51 into the switch. Thus, the safety switch 20 may be produced at relatively low cost.

Another embodiment of a safety switch 20′ is shown in FIGS. 7 to 14 in which parts corresponding to those of the first embodiment are indicated by the same but primed reference numerals. The switch 20′ is particularly characterized in that it can be closed only by an authorized person having a separate release member or key 60 adapted to be connected detachably to the switch.

In addition to the release key 60, the switch 20′ differs from the switch 20 in that the upper end portions of the sleeves 39′ of the rocker 36′ of the switch 20′ contain pins or detent members 61 (FIGS. 9 and 10) which are urged upwardly by the springs 40′. The pins extend upwardly through holes 62 (FIG. 10) in the rocker 36′ and normally extend upwardly into holes 63 formed through the latch 45′ (see FIGS. 9 and 10). Thus, the pins 61 normally prevent the latch 45′ from being slid from left-to-right to its unlatched position.

Figure 11:
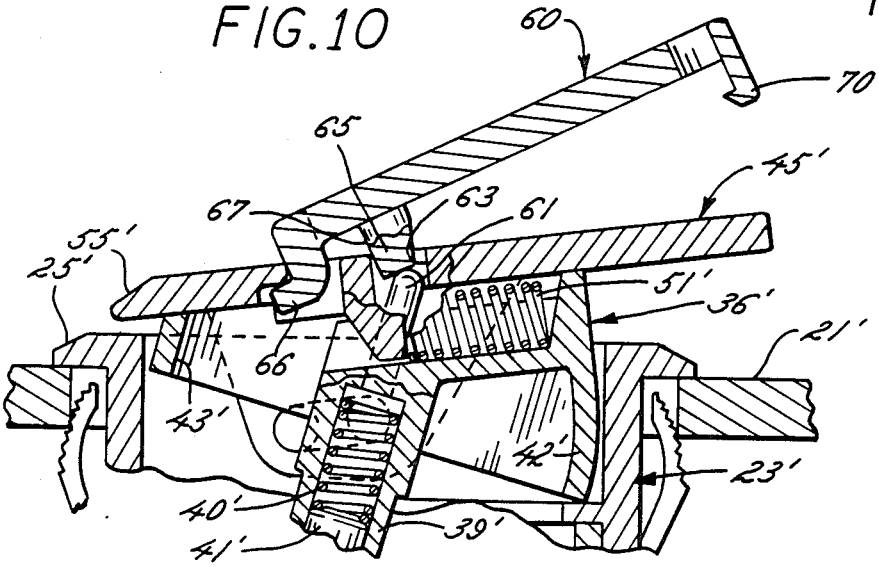
FIG. 11 is a view similar to FIG. 8 but shows a separate release member being attached to the switch.

When the release key 60 is attached to the switch 20′, the pins 61 are pushed downwardly out of the holes 63 in the latch 45′ to permit the latch to be pulled to its unlatched position. For this purpose, the release key 60 is in the form of a plastic plate having a pair of laterally spaced lugs 65 (FIG. 11) depending from its underside and sized to fit in the holes 63 in the latch 45′. One end of the key 60 is formed with an L-shaped tab 66 (FIG. 7) which is adapted to be inserted into a similarly shaped opening 67 in the latch 45′. When the key 60 is tilted as shown in FIG. 11, the tab 66 may be inserted into the opening and, at that time, the lugs 65 extend partially into the holes 63. The key 60 then is pushed downwardly into face-to-face engagement with the upper side of the latch 45' and, as an incident thereto, a flexible catch 70 on the end of the key opposite the tab snaps releasably beneath the handle 47' of the latch 45' and thereby connects the key detachably to the latch.

Figure 12:
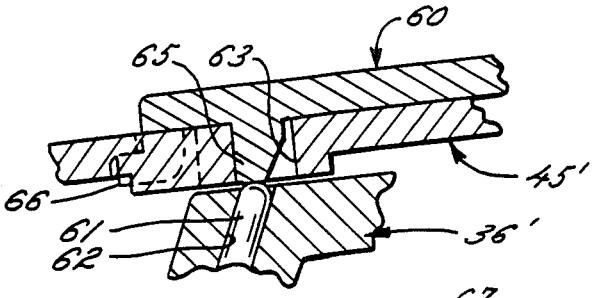
FIG. 12 is a view similar to FIG. 10 but shows the position of the components after the separate release member has been completely attached to the switch.
Figure 13:
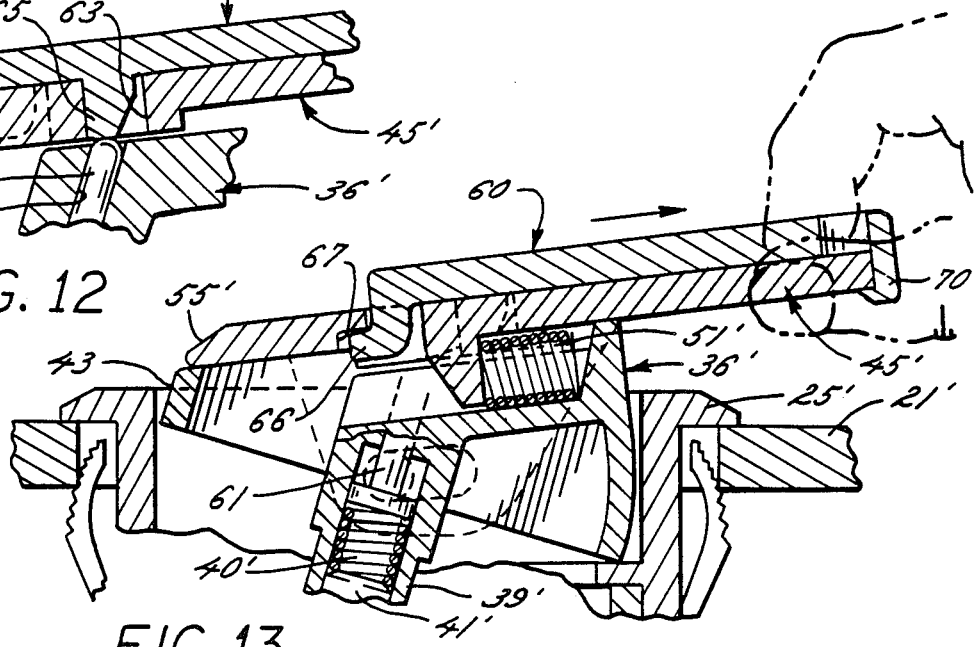
FIGS. 13 and 14 show successively moved positions of certain components of the switch of FIG. 8.
Figure 14:
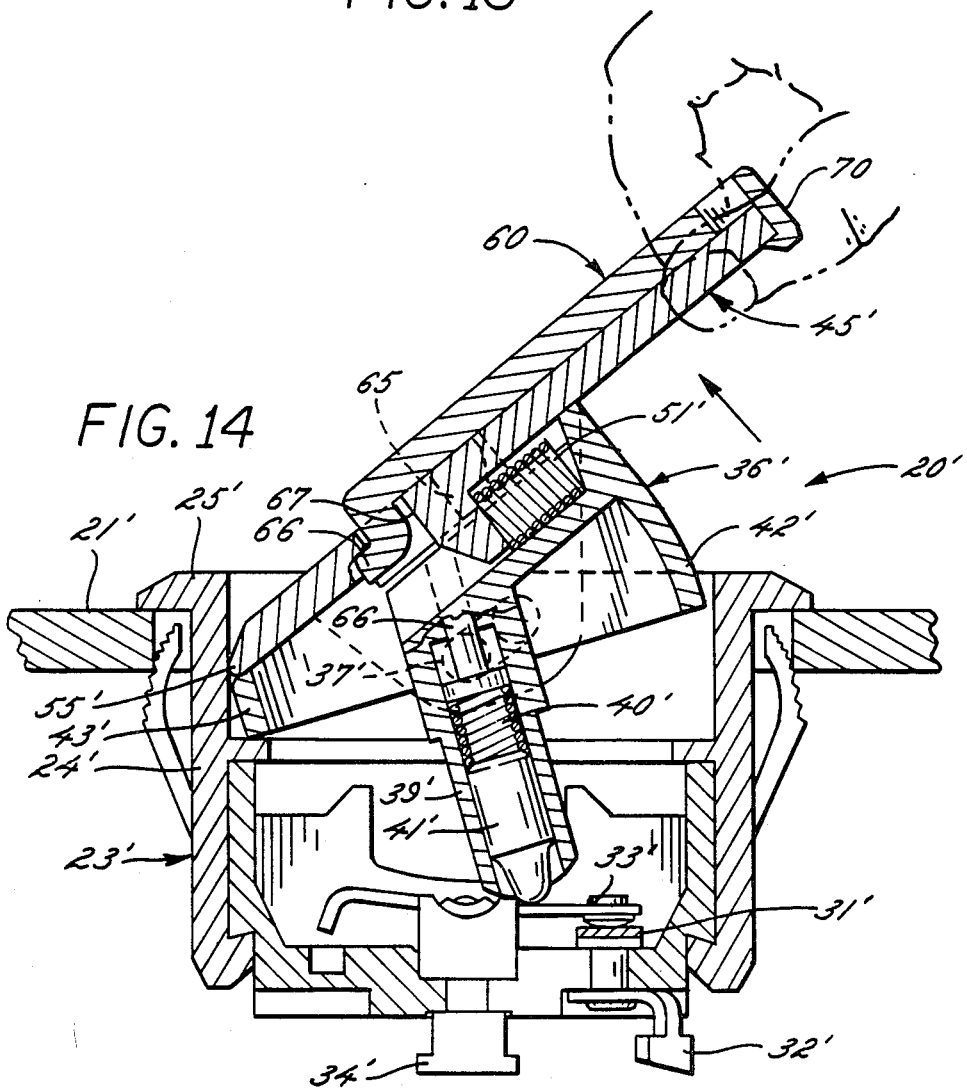

As the key 60 is attached to the latch 45' the lugs 65 push the pins 61 downwardly out of the holes 63 in the latch and thereby free the latch for movement to its unlatched position (see FIGS. 12 and 13). Once the latch has been so moved, the rocker 36' may be pivoted counterclockwise to its switch-closed position by lifting upwardly on the latch and the key as shown in FIG. 14. One end of the key is formed with an enlarged handle or gripping portion 72 (FIG. 7) to facilitate upward lifting.

Thus, the switch 20' operates the same as the switch 20 except that the switch 20' can be closed only by an authorized person having an appropriate key 60. When that person leaves the switch 20', he may detach the key from the latch 45' to cause the pins 61 to return to the holes 63 and thereby prevent unauthorized tampering with the switch.

Still another embodiment of a switch 20'' is shown in FIGS. 15 to 19 in which parts corresponding to those of the switch 20' are indicated by the same but double primed reference numerals. The switch 20'' differs from the switch 20' in that, once the key 60'' has been attached to the latch 45'' and once the latch 45'' has been released, the switch 20'' thereafter may be closed repeatedly with a simple lift-up motion and without need of pulling on the latch prior to pivoting the rocker 36'' downwardly.

Specifically, the rocker 36'' of the switch 20'' is formed with a flexible cantilevered finger 75 which is located beneath the latch 45'' and projects part way across the bottom of the opening 67'' in the latch. When the key 60'' is first attached to the latch 45'', the tab 66'' of the key flexes the finger 75 downwardly as shown in FIG. 15.

When the latch 45'' is first pulled from left-to-right to its unlatched position, the tab 66'' of the key 60'' is retracted to a position located to the right of the free end of the finger 75 as shown in FIG. 17. As a result, the finger 75 springs upwardly into face-to-face engagement with the underside of the latch 45''. When the latch 45'' is subsequently released to the action of the spring 40'', the free end of the finger 75 engages the tab 66'' of the key 60'' and prevents the latch from returning to its latched position. As a result, the rocker 36'' may be lifted to its switch-closed position (FIG. 18), may be depressed to its switch-open position (FIG. 19) and may be re-lifted to its switch-closed position without need of pulling on the latch between successive closings.

We claim:

1. A safety switch comprising a body having a switch contact, a switch actuator adapted to be moved between first and second positions relative to said body to change the state of said switch contact, a latch mounted on said actuator, said latch having a handle portion positively affixed thereto and extending out of said body, said latch and handle portion being movable with said actuator between said first and second positions and movable relative to said actuator between latched and unlatched positions, means biasing said latch toward said latched positions, said latch positively engaging said body when said latch is in said first position and acting and acting to prevent movement of said actuator to said second position, and said latch being manually movable to said unlatched position by manipulation of said handle portion for enabling movement of said actuator to said second position.

2. A safety switch as defined in claim 1 in which said actuator is supported by said body to pivot back and forth between said first and second positions.

3. A safety switch as defined in claim 1 in which said latch is supported by said actuator to slide back and forth between said latched and unlatched positions.

4. A safety switch comprising a body having a switch contact, a switch actuator adapted to be moved between first and second positions relative to said body to change the state of said switch contact, a latch movable with said actuator between said first and second positions and movable relative to said actuator between latched and unlatched positions, means biasing said latch toward said latched position, said latch positively engaging said body when said latch is in said latched position and said actuator is in said first position and acting to prevent movement of said actuator to said second position, said latch releasing said body when said latch is moved to said unlatched position thereby to enable movement of said actuator to said second position, detent means acting on said latch and normally preventing said latch from being moved form said latched position to said unlatched position when said actuator is in said first position, a release member, and means for detachably connecting said release member to said latch, said release member being operable as an incident to connection of said latch for disabling said detent means and permitting movement of said latch to said unlatched position.

5. A safety switch as defined in claim 4 further including means on said actuator coacting with said release member and preventing said latch from moving fully to said latched position once said latch has been moved to said unlatched position and as long as said release member remains connected to said latch.

6. A safety switch comprising a housing having a switch contact, a switch actuator supported by said housing for pivoting between first and second positions within said housing to change the state of said switch contact, a latch mounted on said actuator, said latch having a handle portion positively affixed thereto and extending out of said housing, said latch and handle portion being pivotable with said actuator between said first and second positions and supported by said actuator for sliding movement relative to said actuator between latched and unlatched positions, means biasing said latch toward said latched position, said latch positively engaging said housing when said latch is in said latched position and said actuator is in said first position and acting to prevent pivoting of said actuator to said second position, said latch being manually movable to said unlatched position by manipulation of said handle portion to enable movement of said actuator to said second position, said latch being free of positive engagement with said housing when said actuator is in said second position thereby to permit said actuator to be returned to said first position simply by pivoting said actuator toward said first position and without need of sliding said latch to said unlatched position.

7. A safety switch as defined in claim 6 in which said latch is pressed into frictional engagement with said housing when said actuator is in said second position.

8. A safety switch as defined in claim 6 further including a detent member on said actuator, a hole in said latch and normally receiving said detent member to prevent said latch from being slid between said latched and unlatched positions, a release member, means for detachably connecting said release member to said latch, said release member being operable when. connected to said latch to push said detent member out of said hole and permit sliding of said latch to said unlatched position, and means biasing said detent member against said release member and operable upon removal of said release member from said latch to return said detent member into said hole.

9. A safety switch as defined in claim 8 further including means on said actuator and coacting with said release member to prevent said latch from sliding fully to its latched position once said latch has been slid to said unlatched position and as long as said release member remains connected to said latch.

10. A safety switch comprising a housing having a switch contact, a switch actuator supported by said housing for pivoting between first and second positions within said housing to change the state of said switch contact, a latch pivotable with said actuator between said first and second positions and supported by said actuator for sliding relative to said actuator between latched and unlatched positions, said latch positively engaging said housing when said latch is in said latched position and acting to prevent pivoting of said actuator to said second position, said latch releasing said housing when said latch is moved to said unlatched position thereby to enable movement of said actuator to said second position, spring means acting between said actuator and said latch and biasing said latch to slide toward said latched position, said latch being free of positive engagement with said housing when said actuator is in said second position thereby to permit said actuator to be returned to said first position simply by pivoting said actuator toward said first position and without need of sliding said latch to said unlatched position, a detent member on said actuator and normally engaging said latch to prevent said latch from being slide between said latched and unlatched positions, a release member, means for detachably connecting said release member to said latch, said release member being operable as an incident to connection to said latch to push said detent member out of engagement with said latch and permit sliding of said latch to said unlatched position, and means biasing said detent member against said release member and operable upon removal of said release member from said latch to return said detent member into engagement with said latch.

11. A safety switch as defined in claim 10 further including means on said actuator and coacting with said release member to prevent said latch from sliding fully to its latched position once said latch has been slid to said unlatched position and as long as said release member remains connected to said latch.

12. A safety switch as defined in claim 10 further including plunger means carried by and movable relative to said switch actuator to change the state of said switch contact as said actuator is moved between said first and second positions, and biasing means urging said detent member and plunger means in opposite directions.

13. A safety switch comprising a housing having a switch contact, a switch actuator having mounting pins projecting therefrom, said housing being formed with holes for receiving said mounting pins to support said actuator for pivotal movement between first and second positions within said housing to change the state of said switch contact, a latch pivotable with said actuator between said first and second positions, said latch being formed with elongated slots for receiving said pins to support said latch for sliding movement relative to said actuator between latched and unlatched positions, said latch positively engaging said housing when said latch is in said latched position and said actuator is in said first position and acting to prevent pivoting of said actuator to said second position, said latch releasing said housing when said latch is moved to said unlatched position thereby to enable movement of said actuator to said second position, spring means acting between said actuator and said latch and biasing said latch to slide toward said latched position, said latch being free of positive engagement with said housing when said actuator is in said second position thereby to permit said actuator to be returned to said first position simply by pivoting said actuator toward said first position and without need of sliding said latch to said unlatched position.

14. A safety switch comprising a body having a switch contact, a switch actuator having mounting pins projecting therefrom, said housing being formed with holes for receiving said mounting pins to support said actuator for pivotal movement between first and second positions relative to said body to change the state of said switch contact, a latch movable with said actuator between said first and second positions, said latch being formed with elongated slots for receiving said pins to support said latch for movement relative to said actuator between latched and unlatched positions, said latch positively engaging said body when said latch is in said latched positive and said actuator is in said first position an acting to prevent movement of said actuator to said second position, said latch releasing said body when said latch is moved to said unlatched position thereby to enable movement of said actuator to said second position, and means biasing said latch toward said latched position.

* * * * *